US009416536B1

(12) United States Patent
Lehane et al.

(10) Patent No.: US 9,416,536 B1
(45) Date of Patent: Aug. 16, 2016

(54) INDEXED SUPPORT BAR

(71) Applicant: USG INTERIORS, LLC, Chicago, IL (US)

(72) Inventors: James J. Lehane, McHenry, IL (US); Abraham M. Underkofler, Waukegan, IL (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/800,905

(22) Filed: Jul. 16, 2015

(51) Int. Cl.
*E04B 2/00* (2006.01)
*E04B 9/06* (2006.01)
*E04B 9/18* (2006.01)

(52) U.S. Cl.
CPC ..... *E04B 9/065* (2013.01); *E04B 9/183* (2013.01); *E04B 2103/06* (2013.01)

(58) Field of Classification Search
CPC ..... E04B 9/065; E04B 9/183; E04B 2103/06
USPC ..... 52/506.07, 506.06, 506.08, 509
See application file for complete search history.

(56) References Cited

U.S. PATENT DOCUMENTS 2,055,756 A * 9/1936 Sutton ..... B64C 3/185 296/204
2,059,483 A * 11/1936 Parsons ..... E04B 9/26 52/506.06
3,511,012 A * 5/1970 Brady ..... E04B 9/122 52/506.07
3,559,358 A * 2/1971 Lohse et al. ..... E04F 13/0846 52/235
3,612,461 A * 10/1971 Brown ..... E04B 9/18 248/317
5,044,138 A * 9/1991 Zaccardelli ..... E04B 9/122 52/506.07
5,077,951 A * 1/1992 Baker ..... E04B 9/0478 52/106
5,279,091 A * 1/1994 Williams ..... E04B 2/7457 52/241
D365,645 S * 12/1995 Posenaer ..... D25/125
6,047,517 A * 4/2000 Vrame ..... E04B 9/006 52/220.6
6,199,343 B1 * 3/2001 Sauer ..... E04B 9/068 403/347
7,278,243 B2 * 10/2007 Jones ..... E04B 9/068 52/287.1
7,478,787 B2 * 1/2009 Bankston ..... E04B 9/18 248/343
7,516,585 B2 * 4/2009 Lehane, Jr. ..... E04B 9/068 29/897.312
7,578,107 B2 8/2009 Platt
8,898,986 B1 * 12/2014 Underkofler ..... E04B 9/067 52/506.07
9,021,759 B2 * 5/2015 Lehane, Jr. ..... E04B 9/067 52/506.07
2005/0210819 A1 * 9/2005 McGushion ..... E04C 3/07 52/837
2007/0130869 A1 * 6/2007 Platt ..... E04B 9/067 52/506.08
2011/0023400 A1 * 2/2011 Field ..... E04B 9/068 52/506.07

* cited by examiner

*Primary Examiner* — Basil Katcheves
*Assistant Examiner* — Joshua Ihezie
(74) *Attorney, Agent, or Firm* — Pearne & Gordon LLP

(57) ABSTRACT

A support bar, and method of its manufacture, for suspending grid members of a suspended ceiling, the bar being formed of a length of a sheet metal strip, a lower portion of the bar having regularly spaced holes for receiving and supporting bulbs of grid runners, an upper portion of the bars having longitudinally extending formed ribs, the ribs extending laterally from both sides of a central plane in which the lower portion lies.

9 Claims, 4 Drawing Sheets

INDEXED SUPPORT BAR

BACKGROUND OF THE INVENTION

The invention relates to suspended ceiling systems and, in particular, to improved support bars for carrying grid runners.

PRIOR ART

Support bars are known, for example, from U.S. Pat. Nos. 7,578,107 and 8,898,986. The products disclosed in these patents can be used to suspend main runners or tees so that suspension wires are reduced and the suspension grid is more uniformly positioned vertically and horizontally.

Typically, support bars are produced with regularly spaced formations that capture the reinforcing bulbs of a grid main runner. The support bars are joined at their ends to span distance greater than their individual lengths. There is a need to reduce the cost of manufacture of support bars, to increase their vertical and horizontal beam strength for a given weight, to reduce packaging volume, and improve handle-ability, and to facilitate their installation.

SUMMARY OF THE INVENTION

The invention provides an improved sheet metal support bar and a method of its manufacture. The inventive support bar includes novel longitudinally extending ribs at a region adjacent an upper edge. Besides a primary function of vertically and laterally stiffening the sheet metal support bar, the ribs serve to vertically index the end of a support bar being installed to the end of the last installed support bar. The support bars can be quickly and accurately indexed to one another by holding their ends lapped together and by sliding the support bar currently being installed until preformed screw holes in both support bars are at least partially aligned. A pointed screw driven through both holes assures accurate, full horizontal and vertical registration between the support bars previously installed and presently being installed.

The disclosed stiffening ribs, additionally, serve to guide a suspension wire into a preformed receiving hole so that precise alignment of the suspension wire with a suspension hole is unnecessary.

The suspension holes are advantageously located relative to a central plane of the support bar so that the support bar hangs vertically thereby making later assembly of a grid member more easily accomplished and with greater positional accuracy. A formation for receiving a grid member is preferably proportioned to develop a friction locking fit so that the risk of relative slipping between the support bar and grid runner is reduced. The disclosed rib configuration is compatible with existing clip hardware used, for example, to attach grid runners to wall mounted angles and channels.

The support bar is preferably made from coiled sheet metal stock by a rolling process to achieve a low manufacturing cost. The support bar has an asymmetric section with reference to a longitudinal axis in the plane of the sheet stock and centered between top and bottom edges of the support bar and has a slotted bottom edge. This asymmetry and slotted edge make roll forming problematic. The invention overcomes this circumstance by simultaneously roll forming a pair of support bars in a mirror image relation from a common sheet metal strip. Once the cross-sections are established, the strip or ribbon of stock material is split along its center to yield two support bars.

DESCRIPTION OF THE PREFERRED EMBODIMENT

Figure 1:
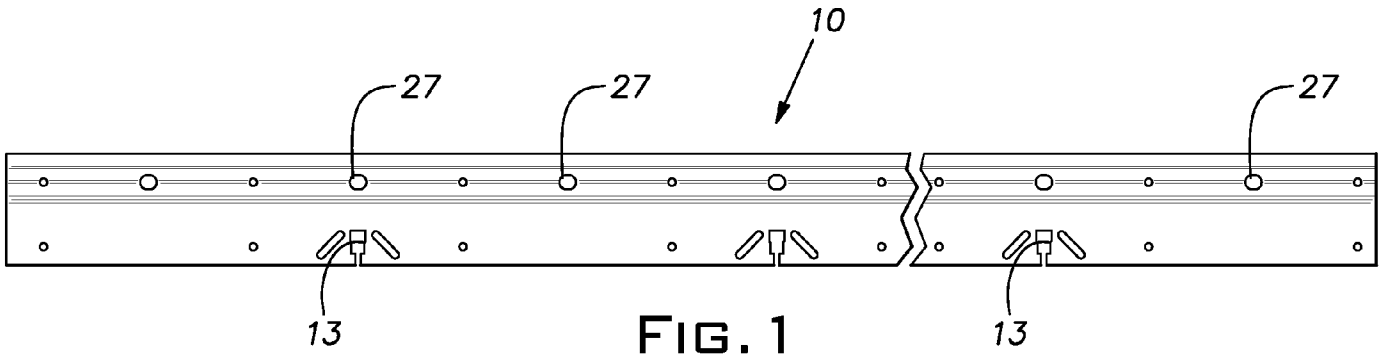
FIG. 1 is a fragmentary side view of a support bar embodying the invention, being foreshortened to obtain a sufficiently large scale.
Figure 2:
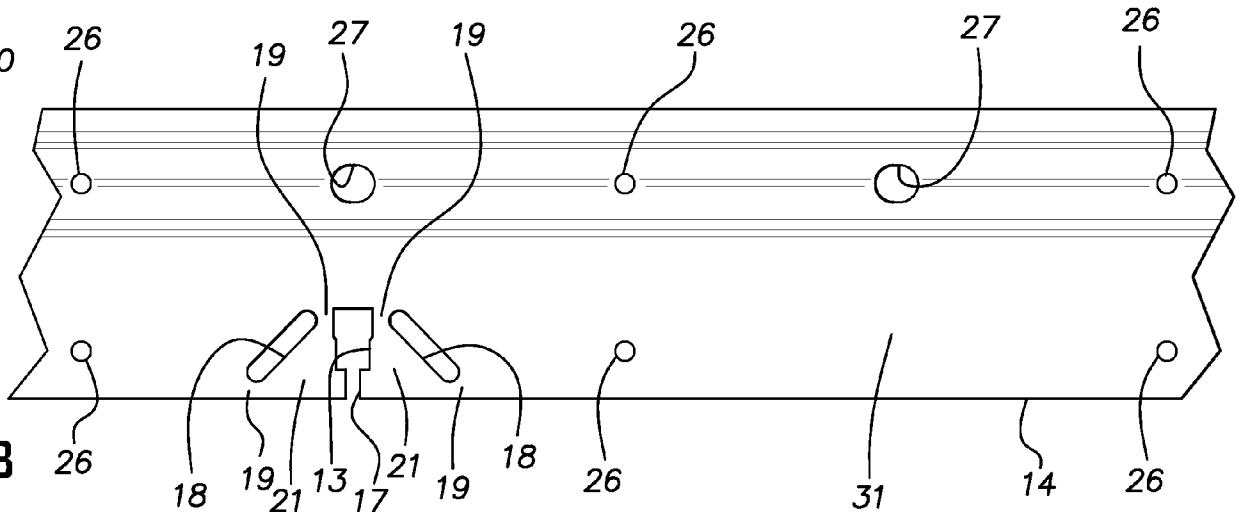
FIG. 2 is a fragmentary side view of the support bar on an enlarged scale.
Figure 3:
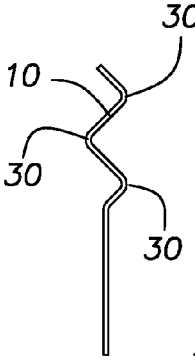
FIG. 3 is an end view of the support bar.
Figures 8, 9:
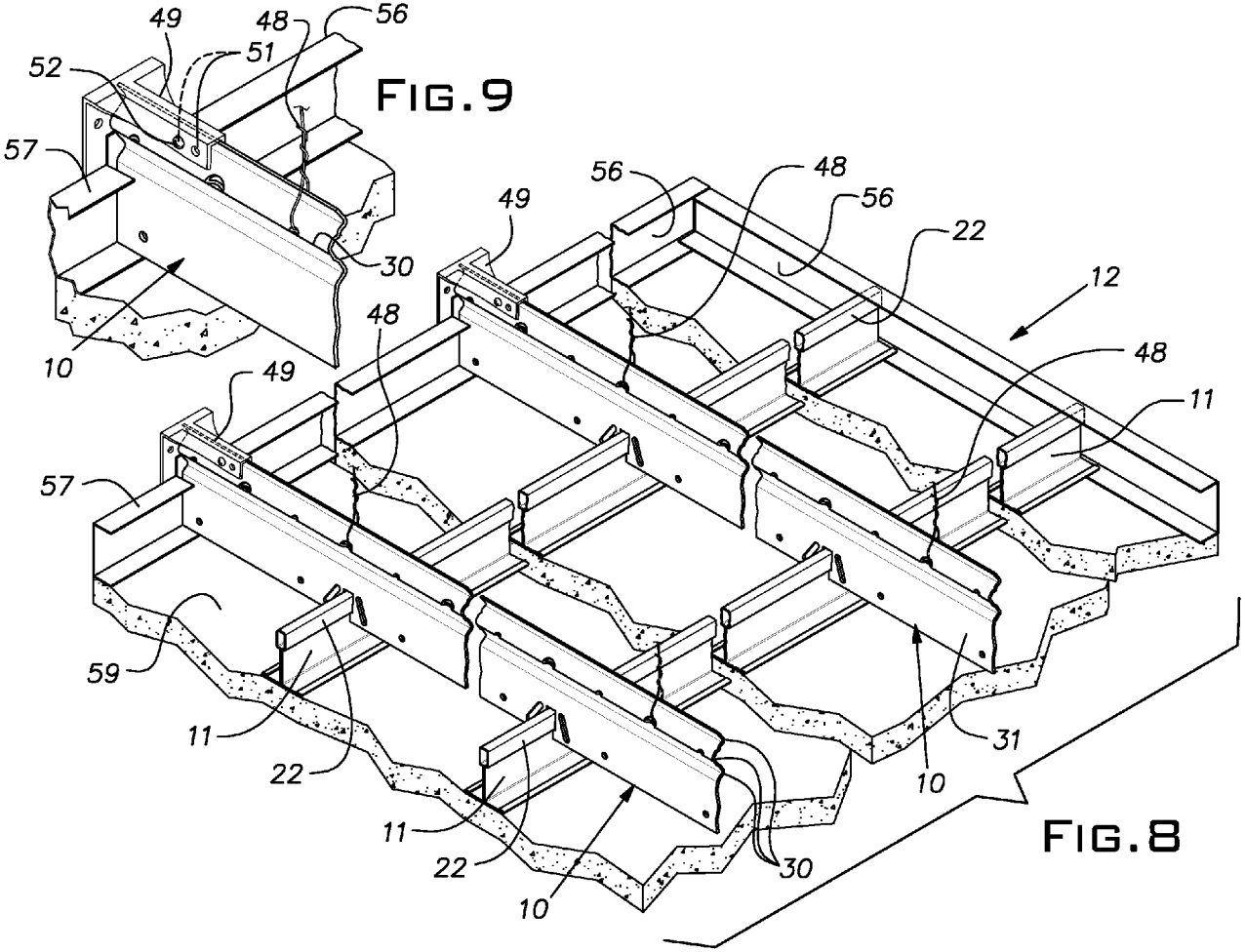
FIG. 8 is a diagrammatic isometric view from above of a suspended ceiling employing the support bars of the invention.
FIG. 9 is an enlarged fragmentary isometric view of an attachment clip and support bar assembly.

FIGS. 1-3 illustrate details of a support bar of the invention used to suspend main grid runners for a suspended ceiling such as that depicted in FIG. 8, designated by the numeral 12. The support bar is a sheet metal body, preferably roll formed, of, for example, 0.032/0.036 inches gauge, G40 hot dipped galvanized (HDG) stock. A convenient length of the support bar is 109½ inch, although other lengths may be produced as desired. The illustrated support bar has a nominal height of 2⅛ inches, although other heights can be provided.

A grid runner bulb engaging feature with the general shape of a rectangular hole 13 is repeated at regular intervals, for example, on an 8 inch spacing, at a lower edge 14 of the support bar. A slot 17 centered with the rectangular hole 13 is open from the hole to the edge 14. Angled slots 18 leave hinge areas 19 to facilitate manual bending of a left or right tab 21 out of the plane of the support bar. Such displacement of a tab 21 permits a grid runner bulb 22 to be assembled with lateral movement into the area of the hole 13. The bent tab 21 is thereafter bent back into the plane of the support bar to capture the grid runner bulb 22 in the hole 13. The lower half of the hole 13 may be somewhat narrower to provide, for example, 0.005 inches of interference with the sidewalls of a bulb 22. When captured by the restored tab 21, the support bar suspends the grid runner 11 and, when the ceiling is completed, any associated underlying areas of the ceiling structure.

A set of four spaced holes 26, two symmetrically disposed on each side of a vertical center line of a rectangular hole 13 (FIG. 2) are punched or otherwise formed in the support bar 10 for optional use when the support bar is an additional support bar as explained below. Larger holes 27 are punched or otherwise formed on centers above the rectangular holes 13 and midway between adjacent rectangular holes.

A series of longitudinally extending stiffening ribs 30 are formed in the upper half of the support bar 10. Preferably, the ribs 30 have V-shaped cross-sections with flat sides disposed at right angles relative to each other and at 45 degrees relative to the plane of a lower half 31 of the support bar. In the illustrated arrangement, the peaks of the ribs 30 on both sides of the support bar 10 have the same distance from the plane of the lower half 31 of the support bar. In the illustrated example, the peak-to-peak distance (from the left side to the right side of FIG. 3) is nominally 0.29 inch. Upper ones of the small holes 26 and the larger holes 27 can be advantageously centered on a crease in the sheet metal at a peak of one of the ribs 30.

Figure 7A:
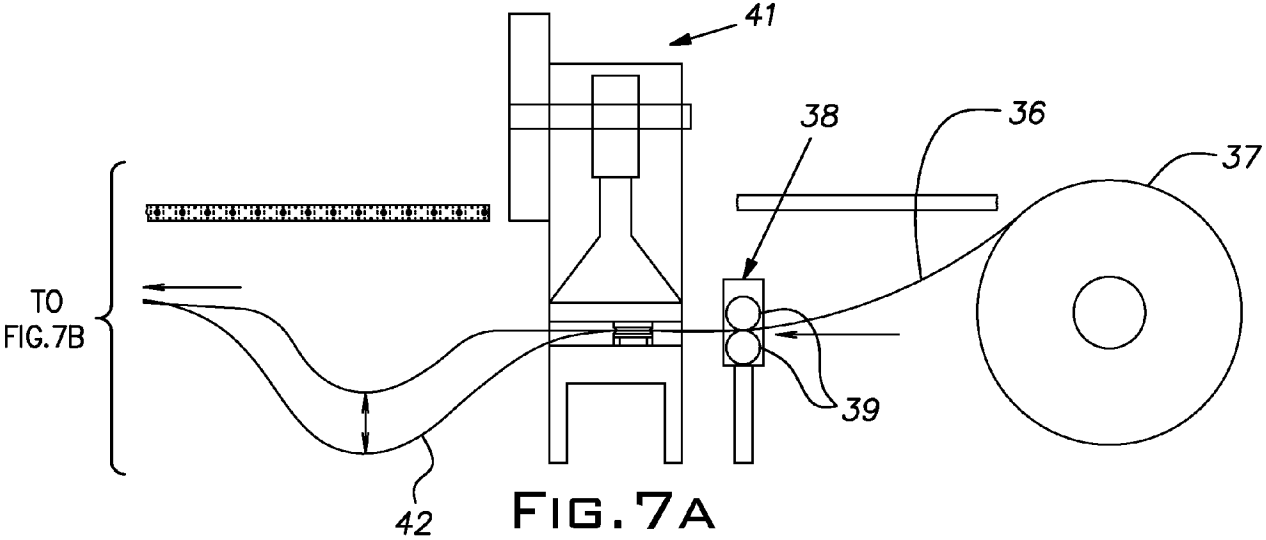
FIGS. 7A and 7B together show stamping, roll forming and cutoff machinery for producing the support bar of the invention.
Figure 7B:
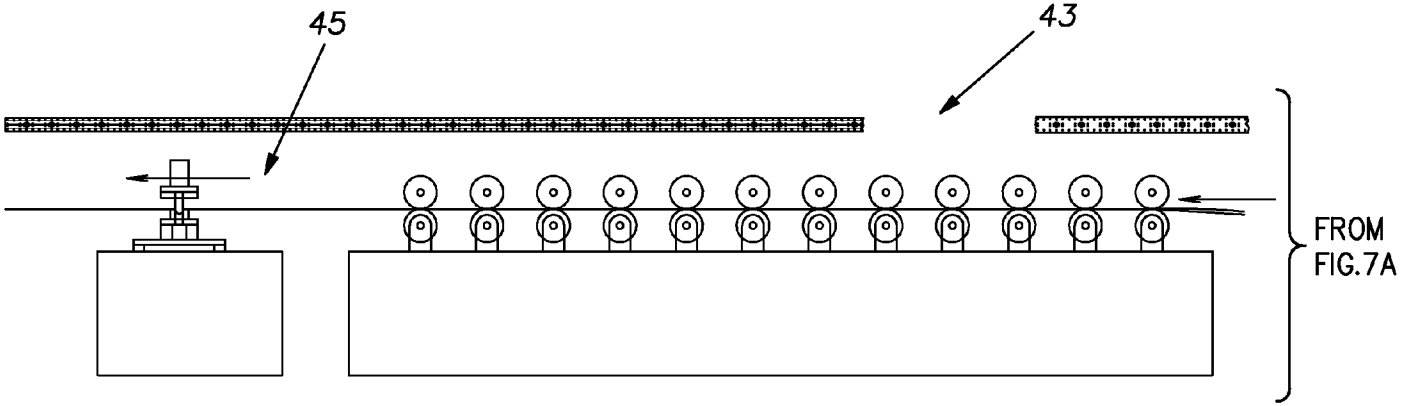

FIGS. 7A and 7B illustrate a roll forming process for producing the support bar 10. A strip of sheet metal stock 36 is fed from a supply coil 37 by feed apparatus 38 having a pair of feed rollers 39. The feed apparatus or station 38, feeding the coil stock 37 intermittently, delivers sheet stock to a punch press 41 where holes 13, 26, 27, and slots 17, 18 are progressively punched out of the sheet stock 36. An accumulator or sag section 42 of sheet stock material is established between the punch press 41 and a roll set 43. The length of the section 42 varies cyclically to account for the intermittent feed through the punch press 41 and a uniform line speed established through the roll set 43. In the illustrated example, the profile of the support bar is formed in the first eight roll passes.

Figure 4:
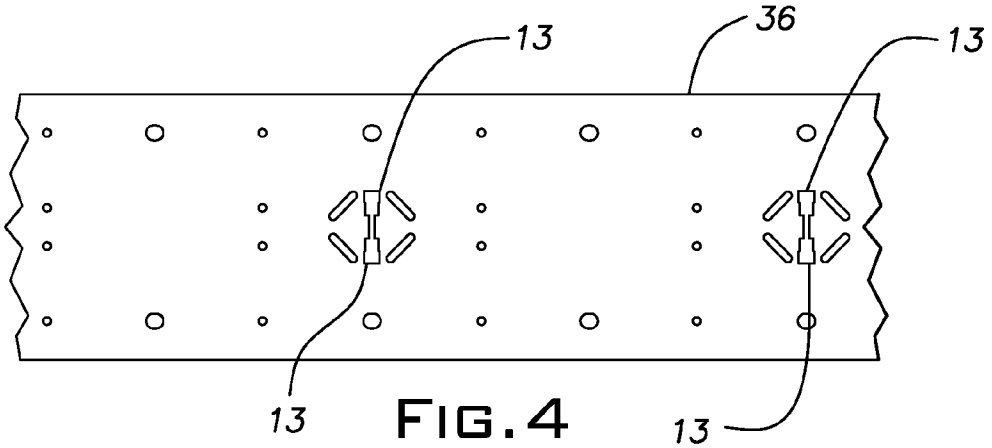
FIG. 4 is a plan view of a section of a punched sheet or ribbon of coil stock.
Figure 5:
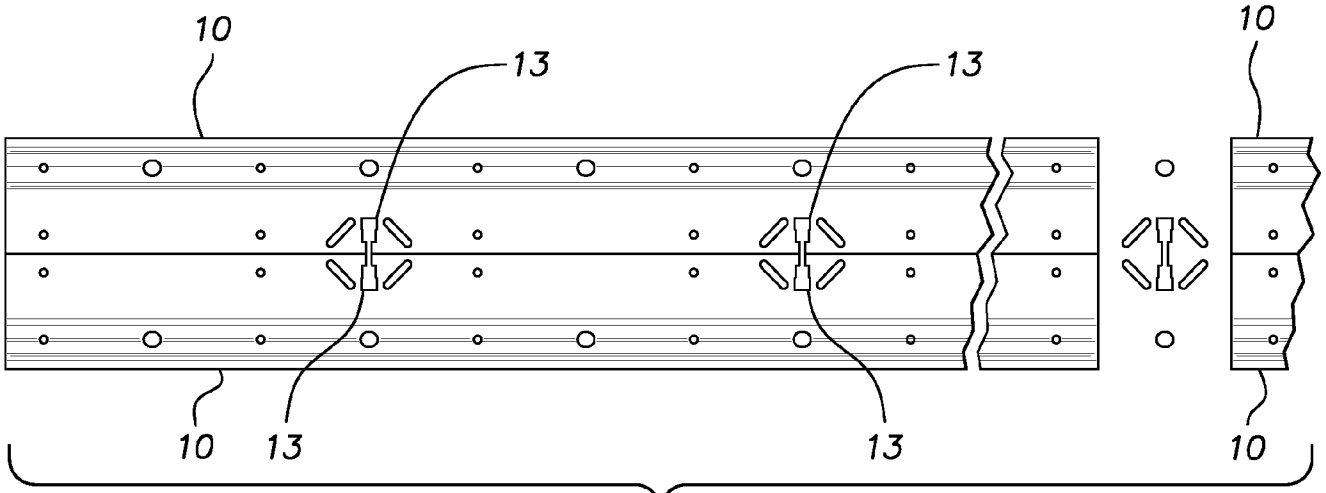
FIG. 5 is a plan view of the sheet metal ribbon after passing through a roll forming station and a cutoff station.
Figure 6:
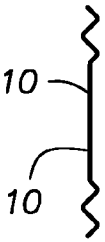
FIG. 6 is a cross-section of the strip of FIG. 5.

The support bar is inherently difficult to roll form because of the ribs 30 on one lateral side and the slots 17 at the other. This difficulty is overcome, in accordance with the invention, by forming two support bars simultaneously on a single strip or ribbon of stock 36. FIGS. 4-6 illustrate details of this process. FIG. 4 shows the holes 13, 26 and 27 and slot 17, 18 as they are produced in the punch press 41. These features are arranged as mirror images with one another such that they are symmetrical about a longitudinal center line of the sheet metal strip or ribbon 36.

In the roll forming station 43, opposite marginal areas of the strip are formed with the ribs 30, again symmetrically disposed with respect to the longitudinal center line of the strip. The strip 36 is slit at the second last roll station and reformed at the last roll station.

A flying cutoff device 45, with blades moving in unison with the line speed of the stock 36 in the roll forming station cuts the strip 36 to the length of the support bar. This involves cutting a slug of 2.5 inches from the strip which is divided between the trailing ends of two support bars and the leading ends of two successive support bars. This slug cutoff is depicted at the right of FIG. 5. The support bars can be stacked in a carton or otherwise readied for packaging after being cut to length at the cutoff station. For a given line speed, the disclosed apparatus and method has twice the production of equipment that would form a single support bar from a metal strip.

FIG. 8 illustrates an example of a suspended ceiling in which the support bar 10 is used. Typically, the support bars 10 are located on 4 foot centers and are suspended by wires 48 from overhead structures, as is customary. Inspection of FIGS. 2 and 3 reveals that the top edge of the suspension wire hole 27 is preferably in, or at least immediately adjacent, the plane of the lower half of the support bar 10 so that the support bar hangs vertically, making measurements and other steps in the ceiling installation more convenient, accurate and faster.

At the perimeter of the ceiling 12, the support bar can be anchored to a wall using conventional clips 49 ordinarily used to anchor grid runners. The width of the support bar measured between two opposed ribs 30 is sufficiently narrow to fit in the clip where ordinarily a reinforcing bulb of a grid runner would be received. Preformed holes 51 in the clip 49 for screws, ordinarily used to attach to a reinforcing bulb of a grid runner, can be used to anchor the clip to the support bar with self-drilling screws 52. Grid runners 53 are assembled to the support bar by positioning their upper reinforcing bulbs 22 in a respective hole 13 when one of the tabs 21 is manually bent out of the plane of the support bar 10 using a pliers or other suitable tool. With a bulb 22 received in a hole 13 and properly located longitudinally, the associated tab 21 is manually bent back into its original plane. The hole 13, as mentioned, is slightly smaller than the bulb 22 so that the grid runner 11 is frictionally locked in position.

As shown in FIG. 8, the ceiling 12 can include wall channels 56 for supporting ends of grid runners 11. An upper flange 57 of a wall channel 56 can be locally cut on both sides of a support bar location for clearance with the end of the support bar. The severed part of the flange 57 can be bent upwardly to a vertical position. The clip 49 can be assembled behind the channel and fastened to a wall with a suitable screw.

The disclosed features of the support bar facilitate assembly of multiple support bars where the span of the ceiling area is greater than the length of a single support bar. Referring to FIG. 5, it will be understood, due to the slug cutoff discussed above, the end of a support bar will not interfere with the last hole 13 or a grid runner in such hole where the ends of two support bars are lapped and the center-to-center distance between hole 13 is maintained.

The ribs 30 make the lapped support bar ends self-centering in the vertical direction and guide the ends horizontally until a set of holes 26 are roughly aligned. A self-tapping screw driven in any pair of the roughly aligned holes will precisely register the support bars together with the desired center-to-center distances of the holes 13 of lap-jointed support bars 10.

The geometry of the support bar lends itself to a compact stacking arrangement for packaging since the ribs 30 nest on one another and no lateral shifting of a stack is experienced. Moreover, the lateral stiffness of the support bar makes a package of multiple support bars more handleable than that of prior art products.

While the illustrated suspended ceiling is faced with drywall sheets attached to the lower faces of the grid runners 11, it will be understood that the support bar is readily used with grid runners supporting acoustical tiles.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A support bar for suspending grid members of a suspended ceiling, the bar being formed of a length of a sheet metal strip, a lower portion of the bar having regularly spaced holes for receiving and supporting bulbs of grid runners, an upper portion of the bar having longitudinally extending formed ribs, the ribs extending laterally from both sides of a central plane in which the lower portion lies, a plurality of fastener holes positioned to register with a plurality of fastener holes of a second support bar identical to said first mentioned support bar when said second support bar is lapped over an end of said first-mentioned support bar, at least some of said fastener holes being situated at a peak of one of said ribs.

2. A support bar as set forth in claim 1, wherein the ribs are angular in cross section.

3. A support bar as set forth in claim 2, wherein the ribs have planar sides lying in planes oriented at 45 degrees to said central plane.

4. A support bar as set forth in claim 1, wherein opposite ends of the support bar each extend a distance from an adjacent bulb receiving hole less than the regular spacing between said bulb receiving holes.

5. A support bar as set forth in claim 1, wherein said fastener holes are in a repeating pattern, each pattern being symmetrically disposed about a bulb receiving hole.

6. A support bar as set forth in claim 5, wherein suspension wire holes are formed at a peak of one of said ribs.

7. A support bar as set forth in claim 6, wherein said suspension wire holes have an upper edge at said central plane.

8. A support bar as set forth in claim 1, wherein a width of the support bar measured across the ribs at an upper region of the support bar is nominally 0.29 inch whereby said support bar is compatible with existing wall attachment clips.

9. A support bar as set forth in claim 1, wherein the bulb receiving holes are proportioned to provide a friction lock on the bulb of a grid member.

* * * * *